US006273748B1

(12) United States Patent
Komatsu et al.

(10) Patent No.: US 6,273,748 B1
(45) Date of Patent: Aug. 14, 2001

(54) ELECTRICAL CONNECTOR ASSEMBLY

(75) Inventors: Hiromichi Komatsu, Yamoto; Masahiro Sakano, Ebina, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/616,684

(22) Filed: Jul. 14, 2000

(30) Foreign Application Priority Data

Aug. 5, 1999 (JP) ..... 11-221943

(51) Int. Cl.[7] ..... H01R 12/24
(52) U.S. Cl. ..... 439/496; 439/660
(58) Field of Search ..... 439/496, 492, 439/493, 494, 495, 497, 498, 499, 660, 676

(56) References Cited

U.S. PATENT DOCUMENTS 4,252,397 * 2/1981 Eigenbrode et al. ..... 439/405
5,667,393 * 9/1997 Grabbe et al. ..... 439/83
5,975,916 * 11/1999 Okura ..... 439/74

* cited by examiner

*Primary Examiner*—Gary Paumen
*Assistant Examiner*—Ross Gushi
(74) *Attorney, Agent, or Firm*—Stacey E. Caldwell

(57) ABSTRACT

An electrical connector assembly interconnects a flat flexible circuit and a printed circuit board. The assembly includes an elongated female connector having a dielectric housing with a mating face in a top side of the housing and an elongated receptacle in the mating face. A plurality of conductive terminals are mounted on the housing and are spaced along opposite sides of the receptacle. The terminals have flexible contact portions projecting into the receptacle and tail portions for connection to appropriate conductors of the flat flexible circuit at a bottom side of the housing. An elongated male connector includes a plug portion for inserting into the receptacle of the female connector and a plurality of terminals for engaging the contact portions of the terminals of the female connector, along with tail portions for connection to appropriate circuit traces on the printed circuit board.

11 Claims, 4 Drawing Sheets

ELECTRICAL CONNECTOR ASSEMBLY

FIELD OF THE INVENTION

This invention generally relates to the art of electrical connectors and, particularly, to an electrical connector assembly for connecting a flat flexible circuit and a printed circuit board.

BACKGROUND OF THE INVENTION

Various electrical connector assemblies have been designed for terminating a flat flexible circuit, including board-to-board connector assemblies for connecting the flat flexible circuit to a printed circuit board. Such board-to-board connector assemblies often include a female or receptacle connector and a mating male or plug connector. The flat flexible circuit is terminated to one of the connectors typically by inserting an end of the flexible circuit into an elongated mouth of the connector and biasing conductors of the flexible circuit into engagement with conductive terminals of the connector while somehow securing the flexible circuit in the mouth of the connector.

Connector assemblies of the character described above continue to suffer deficiencies and create problems due to the inadequacies and inconsistent contacts at the connecting interface of the connectors of the assembly as well as in the termination area between the flat flexible circuit and one of the connectors. This invention is directed to solving those problems by providing a more efficient and reliable connector assembly than has heretofore been available.

SUMMARY OF THE INVENTION

An object, therefore, of the invention is to provide a new and improved electrical connector assembly for electrically interconnecting a flat flexible circuit and another connecting device such as a printed circuit board.

In the exemplary embodiment of the invention, the connector assembly includes an elongated female connector having a dielectric housing with a mating face in a top side of the housing and an elongated receptacle in the mating face. A plurality of conductive terminals are mounted on the housing and are spaced along opposite sides of the receptacle. The terminals have flexible contact portions projecting into the receptacle and tail portions for connection to appropriate conductors of the flat flexible circuit at a bottom side of the housing.

An elongated male connector includes a dielectric housing adapted for mounting on the printed circuit board. The housing has an elongated plug portion for inserting into the receptacle of the female connector in a mating direction. A plurality of terminals are mounted on the housing and are spaced along the plug portion. The terminals have contact portions on opposite sides of the plug portion for engaging the contact portions of the terminals of the female connector, and tail portions for connection to appropriate circuit traces on the printed circuit board.

According to one aspect of the invention, the dielectric housing of the female connector includes a plurality of terminal-receiving passages communicating with the receptacle in the housing. The passages are open at lateral sides of the housing for insertion thereinto of the terminals of the female connector in a direction transversely of the mating direction.

According to another aspect of the invention, the tail portions of the terminals of the female connector penetrate the flat flexible circuit and are bent beneath the circuit to secure the circuit to the bottom side of the housing of the female connector.

According to a further aspect of the invention, each conductive terminal of the female connector includes a base portion engaged in the housing of the female connector and an S-shaped flexible portion extending from the base portion. One end of the S-shaped flexible portion is integral with the base portion. The contact portion of the terminal is located at an opposite end of the S-shaped flexible portion. The contact portion is bent back adjacent itself to a tip end of the terminal. The tip end is aligned for abutment with the S-shaped portion to provide an anti-overstress means for the contact portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
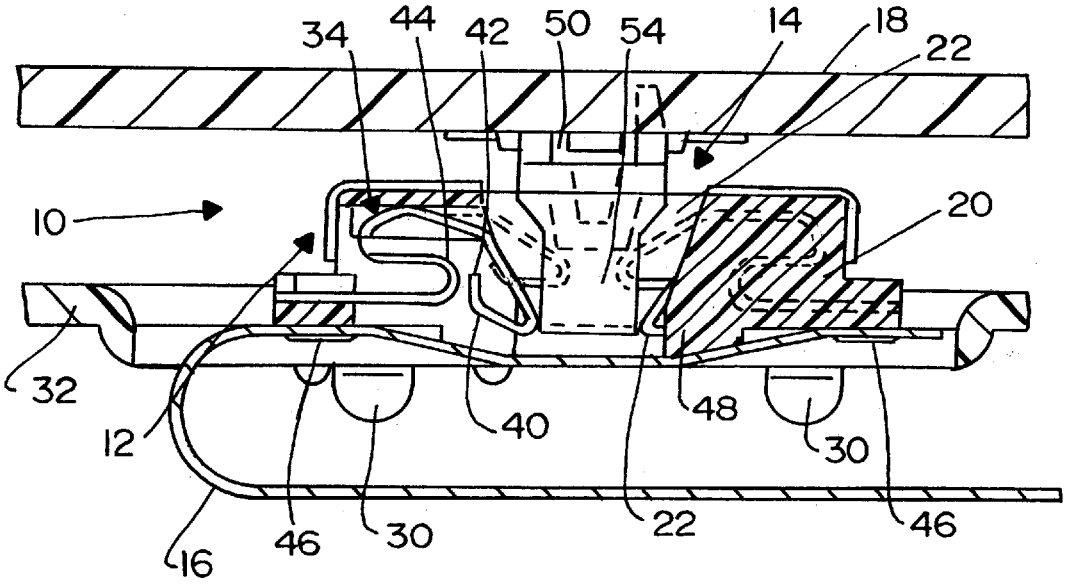
FIG. 1 is a vertical section through an electrical connector assembly embodying the concepts of the invention.

Referring to the drawings in greater detail, and first to FIG. 1, the invention is embodied in an electrical connector assembly, generally designated 10, which includes a female connector, generally designated 12 and a mating male connector, generally designated 14. Female connector 12 is adapted for terminating a flat flexible circuit 16. Male connector 14 is adapted for connection to a printed circuit board 18. Therefore, connector 10 can be considered a board-to-board connector assembly.

It should be understood that the use of such terms as "top", "bottom", "vertical", "horizontal" and the like herein and in the claims hereof are not intended in any way to be limiting because connector assembly 10 obviously can be used omni-directionally. These terms are intended solely for providing a clear and concise description and understanding of the invention.

Figure 2:
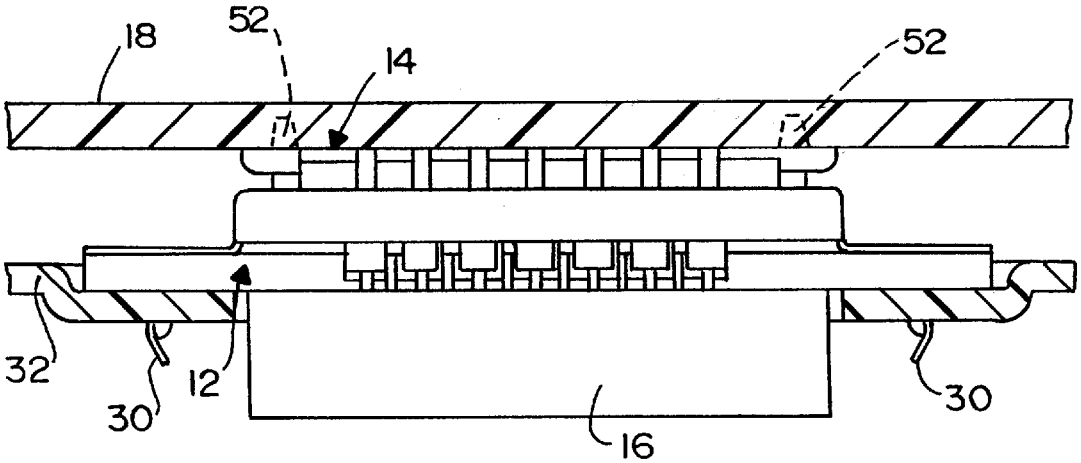
FIG. 2 is a side elevational view of the connector assembly looking toward the left-hand side of FIG. 1.
Figure 3:
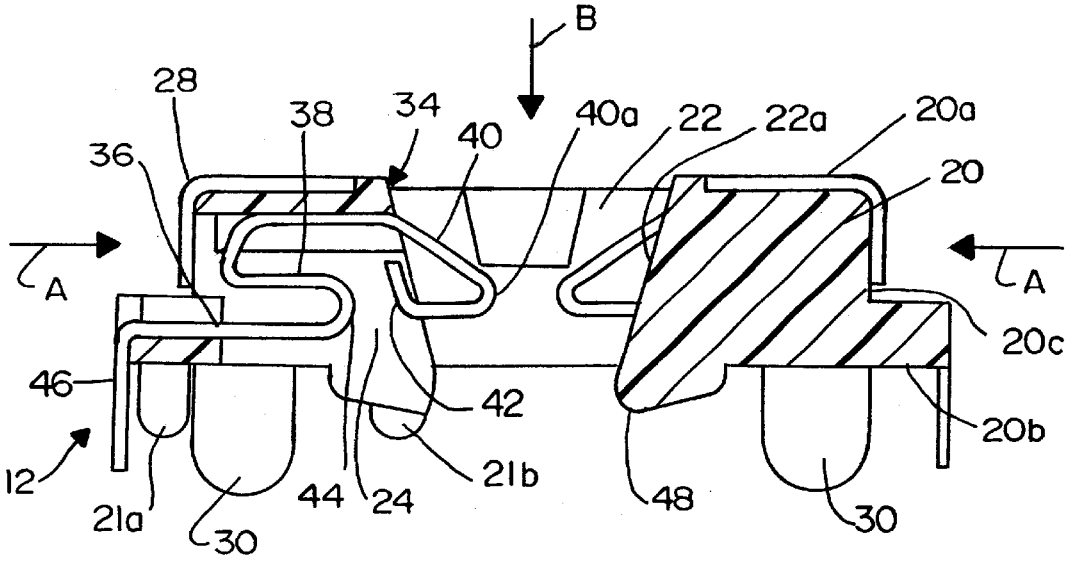
FIG. 3 is a vertical section of the female connector of the assembly similar to that shown in FIG. 1, but with the male connector and the flat flexible circuit removed to facilitate the illustration of the female connector.
Figure 4:
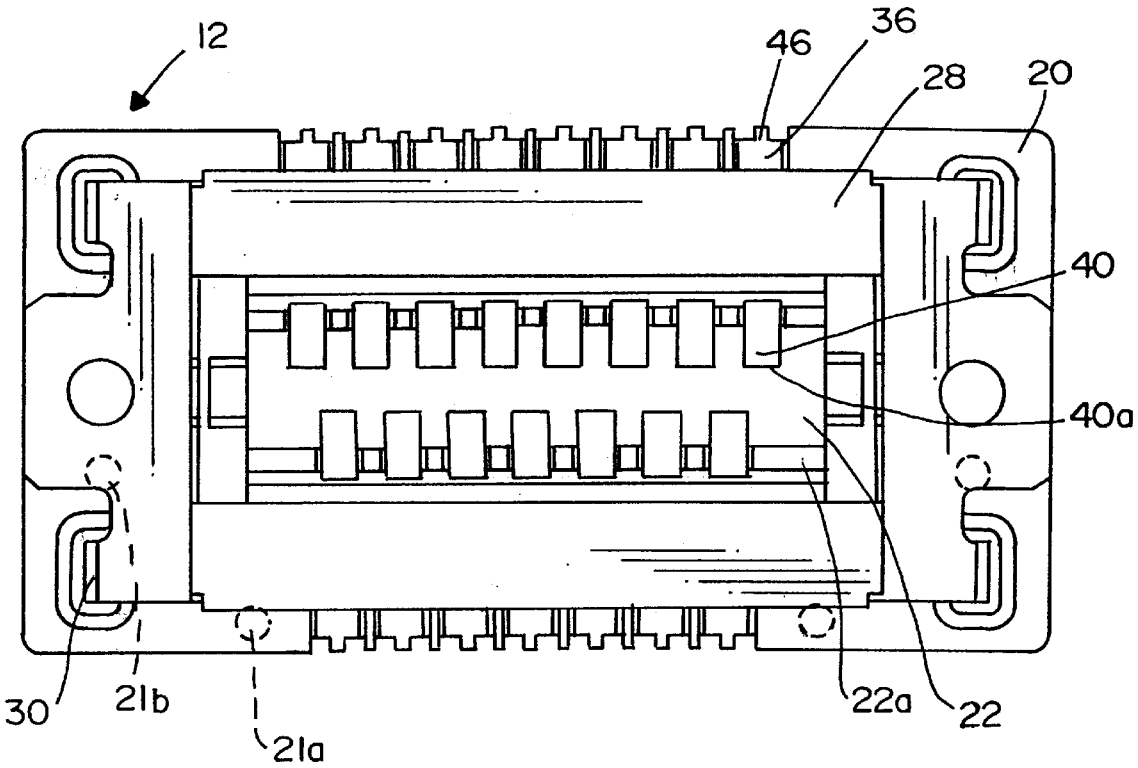
FIG. 4 is a top plan view of the female connector.
Figure 5:
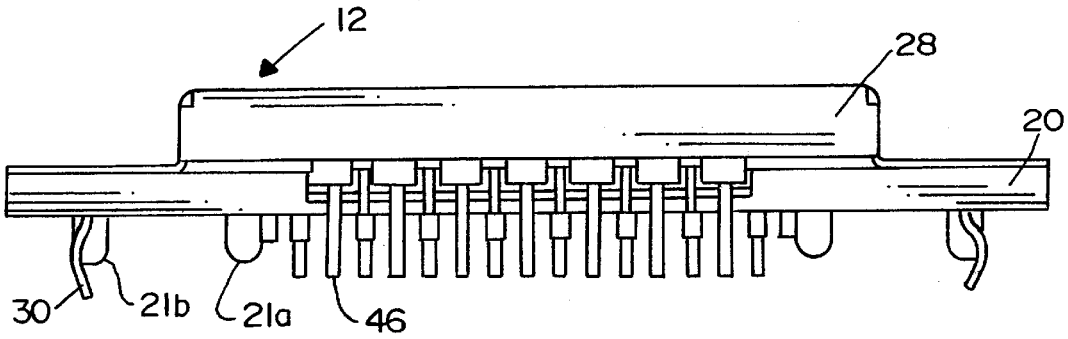
FIG. 5 is a side elevational view of the female connector.
Figure 6:
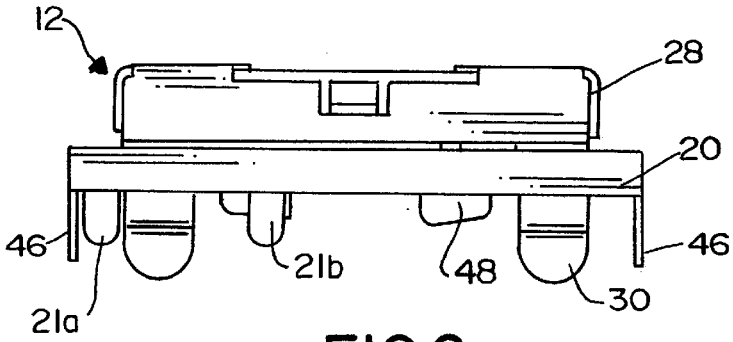
FIG. 6 is an end elevational view of the female connector.

With that understanding, referring to FIGS. 2–6 in conjunction with FIGS. 1 and 2, female connector 12 is elongated as seen in FIGS. 2, 4 and 5 and includes an elongated dielectric housing 20 which may be fabricated of molded plastic material or the like. Positioning pegs 21*a* for the flat flexible circuit 16 and mounting pegs 21*b* for a panel 32 project downwardly from the housing. The housing defines a top side 20*a* and a bottom side 20*b*. A through receptacle 22 extends through dielectric housing 20 between the top side and bottom side thereof. A plurality of terminal-receiving passages 24 communicate with receptacle 22 and are separated by partitions 26. As can be seen by the cross-hatching in FIG. 3, terminal-receiving passages 24 alternate on opposite sides of receptacle 22 lengthwise thereof. Partitions 26 define opposite sides 22*a* of receptacle 22. Passages 24 open at outer lateral sides 20*c* of housing 20.

A metal shell 28 covers the top of dielectric housing 20 of female connector 12. The shell has a plurality of legs 30 which pass through dielectric housing 20 and are used to mount female connector 12 to a panel or other support structure 32 shown in FIGS. 1 and 2. The panel or portions thereof engageable with legs 30 may be conductive for grounding metal shell 28.

A plurality of conductive terminals, generally designated 34, are mounted within terminal-receiving passages 24 of housing 20 of female connector 12. Each terminal includes a base portion 36 press-fit within a respective one of the passages. With the passages being open at lateral sides 20*c* of the housing, the terminals are inserted into the passages in the direction of arrows "A" (FIG. 3) which is transverse or perpendicular to a mating direction of male connector 14 as represented by arrow "B". Each terminal includes an S-shaped flexible portion 38 extending from base portion 36 and is free to move within the respective passage 24. A contact portion 40 extends from S-shaped flexible portion 38 into receptacle 22 to a contact point 40*a*. Contact portion 40 is bent back adjacent itself to a tip end 42 of the terminal. The tip end is aligned with but spaced from an abutment surface 44 of the S-shaped flexible portion of the terminal. Therefore, tip end 42 can engage abutment surface 44 to provide an anti-overstress means for contact portion 40. Finally, a tail portion 46 extends downwardly from an outside end of base portion 36 for penetrating through flat flexible circuit 16 and for connection to a respective conductor of the flexible circuit, as by soldering. As seen in FIG. 1, tail portions 46 of terminals 34 are bent beneath the flat flexible circuit to secure the flexible circuit to the bottom side of female connector 12 in abutment with projections 48 at the bottoms of partitions 26 between passages 24 of the housing.

Figure 7:
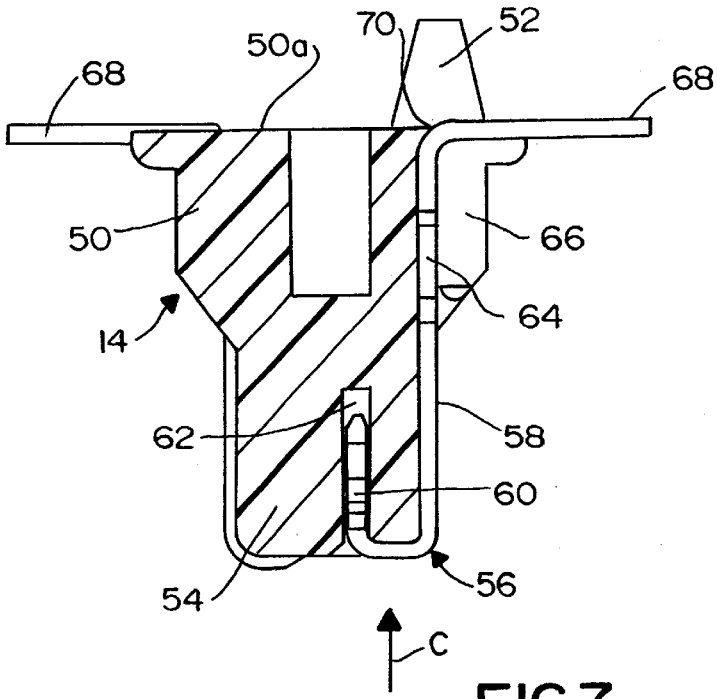
FIG. 7 is an enlarged vertical section through the male connector of the assembly of FIG. 1.
Figure 8:
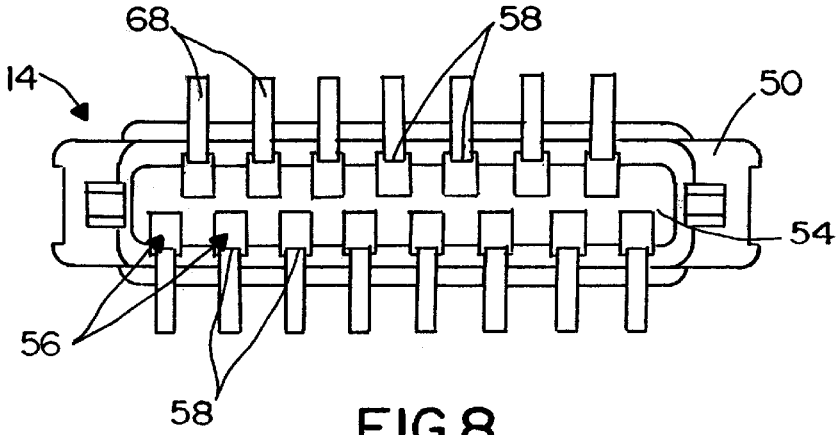
FIG. 8 is a top plan view of the male connector.
Figure 9:
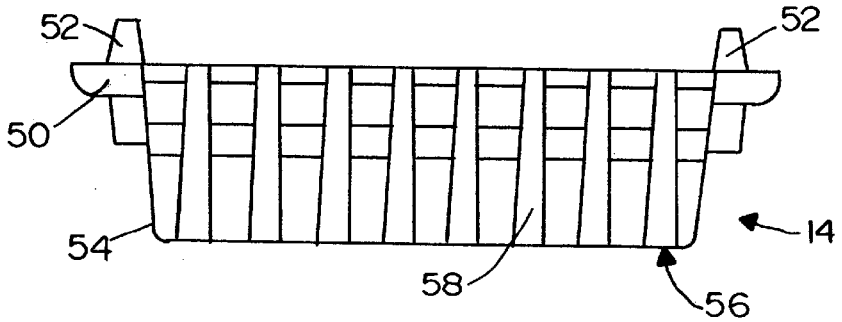
FIG. 9 is a side elevational view of the male connector.
Figure 10:
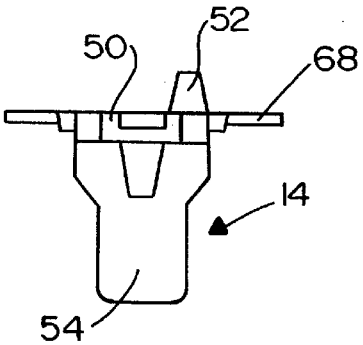
FIG. 10 is an end elevational view of the male connector.

Referring to FIGS. 7–10 in conjunction with FIGS. 1 and 2, and particularly FIG. 7, male connector 14 is elongated as best seen in FIGS. 2, 8 and 9 and includes an elongated dielectric housing 50 fabricated of molded plastic material or the like. The housing includes a top face 50*a* to which printed circuit board 18 (FIGS. 1 and 2) is mounted. The housing has a plurality of mounting posts 52 for insertion into appropriate mounting holes in the printed circuit board. An elongated plug portion 54 projects downwardly of the housing for insertion into receptacle 22 (FIG. 3) of female connector 12 in the direction of arrow "B" shown in FIG. 3, until the two connectors are mated as shown in FIGS. 1 and 2.

A plurality of terminals, generally designated 56, are mounted on housing 50 of male connector 14. As best seen in FIG. 7, each terminal 56 includes a contact portion 58 on a respective side of plug portion 54 of housing 50. The terminals are spaced along the plug portion as best seen in FIG. 9 and contact portions 58 alternate on opposite sides of the plug portion as best seen in FIG. 8 for engaging alternating contact portions 40 on opposite sides of receptacle 22 of female connector 12. Each terminal includes an engaging portion 60 for press-fit into a mounting hole 62 in housing 50, whereby the terminals are mounted onto the housing in the direction of arrow "C" (FIG. 7). A second engaging portion 64 above contact portion 58 is press-fit between partitions 66 of the housing. Finally, each terminal 56 includes a solder tail 68 generally flush with top side 50*a* of housing 50 for connection, as by solder 70 (FIG. 7) to appropriate circuit traces on printed circuit board 18.

When female connector 12 of connector assembly 10 is mated with male connector 14 to electrically interconnect flat flexible circuit 16 with printed circuit board 18 as shown in FIGS. 1 and 2, plug portion 54 of the male connector is inserted into receptacle 22 of the female connector. Contact portions 58 of terminals 56 of the male connector engage contact portions 40 of terminals 34 of the female connector and bias contact portions 40 outwardly from the dotted-line positions shown in FIG. 1 to the full line positions. It can be seen that tip end 42 of the terminal shown in FIG. 1 is biased to a position near abutment surface 44 of the terminal to provide an anti-overstress means should excessive lateral forces be applied during mating of the connectors.

Figure 11:
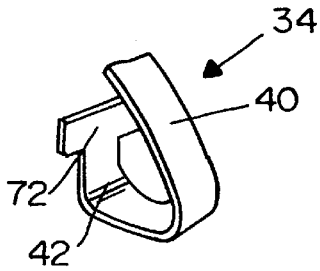
FIG. 11 is a fragmented perspective view of the contact portion of an alternative embodiment of a terminal for the female connector.
Figure 12:
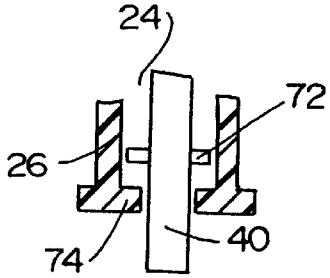
FIG. 12 is a fragmented illustration showing the contact portion of FIG. 11 in a terminal-receiving passage.

FIGS. 11 and 12 show an alternate embodiment of the invention wherein tip end 42 of contact portion 40 of each terminal 34 is provided with a cross portion 72 to ensure that the tip end will engage abutment surface 44 (FIG. 3) should contact portion of the terminal be overstressed. In addition, FIG. 12 shows that partitions 26 which define terminal-receiving passages 24 may be provided with flanges 74 which extend into the passages to guide flexing movement of contact portions 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for electrically interconnecting a flat flexible circuit and a printed circuit board, comprising:

an elongated female connector including a dielectric housing having a mating face in a top side of the housing and an elongated receptacle in the mating face, and a plurality of conductive terminals mounted on the housing and spaced along opposite sides of the receptacle, the terminals having flexible contact portions projecting into the receptacle and tail portions for connection to appropriate conductors of said flat flexible circuit at a bottom side of the housing; and an elongated male connector including a dielectric housing adapted for mounting on said printed circuit board and including an elongated plug portion for inserting into the receptacle of the female connector in a mating direction, and a plurality of terminals mounted on the housing and spaced along the plug portion, the terminals having contact portions on opposite sides of the plug portion for engaging the contact portions of the terminals of the female connector and tail portions for connection to appropriate circuit traces on said printed circuit board, wherein the dielectric housing of said female connector includes a plurality of terminal-receiving passages communicating with said receptacle, the passages being open at lateral sides of the housing for insertion thereinto of the terminals of the female connector in a direction transversely of said mating direction.

2. The electrical connector assembly of claim 1 wherein the tail portions of the terminals of the female connector penetrate the flat flexible circuit and are bent beneath the circuit to secure the circuit to said bottom side of the housing of the female connector.

3. The electrical connector assembly of claim 1 wherein each conductive terminal of the female connector includes a distal end extending from the contact portion thereof in a direction away from the receptacle and in alignment with an abutment portion of the terminal to provide an anti-stress means for the contact portion.

4. The electrical connector assembly of claim 1 wherein each conductive terminal of the female connector includes a base portion engaged in the housing of the female connector and an S-shaped flexible portion extending from the base portion.

5. The electrical connector assembly of claim 4 wherein one end of said S-shaped flexible portion is integral with said base portion, and the contact portion of the terminal is located at an opposite end of the S-shaped flexible portion.

6. The electrical connector assembly of claim 5 wherein said contact portion is bent back adjacent itself to a tip end of the terminal.

7. The electrical connector assembly of claim 6 wherein said tip end of the terminal is aligned for abutment with the S-shaped portion of the terminal to provide an anti-overstress means for the contact portion.

8. An electrical connector assembly for electrically interconnecting a flat flexible circuit and a printed circuit board, comprising:

an elongated female connector including a dielectric housing having a mating face in a top side of the housing, an elongated receptacle in the mating face and a plurality of terminal-receiving passages spaced along and communicating with the receptacle, the passages being open at lateral sides of the housing, and a plurality of conductive terminals inserted into said terminal-receiving passages through the lateral sides of the housing, each terminal including a base portion engaged in the housing and an S-shaped flexible portion extending from the base portion freely into a respective one of said passages, one end of said S-shaped flexible portion being integral with the base portion, a contact portion at an opposite end of the S-shaped flexible portion, and a tail portion for connection to an appropriate conductor of said flat flexible circuit at a bottom side of the housing; and an elongated male connector including a dielectric housing adapted for mounting on said printed circuit board and including an elongated plug portion for inserting into the receptacle of the female connector in a mating direction, and a plurality of terminals mounted on the housing and spaced along the plug portion, the terminals having contact portions on opposite sides of the plug portion for engaging the contact portions of the terminals of the female connector and tail portions for connection to appropriate circuit traces on said printed circuit board, wherein the dielectric housing of said female connector includes a plurality of terminal-receiving passages communicating with said receptacle, the passages being open at lateral sides of the housing for insertion thereinto of the terminals of the female connector in a direction transversely of said mating direction.

9. The electrical connector of claim 8 wherein the contact portion of each terminal of the female connector is bent back adjacent itself to a tip end of the terminal which is aligned for abutment with the S-shaped portion of the terminal to provide an anti-overstress means for the contact portion.

10. The electrical connector assembly of claim 8 wherein the tail portions of the terminals of the female connector penetrate the flat flexible circuit and are bent beneath the circuit to secure the circuit to said bottom side of the housing of the female connector.

11. The electrical connector assembly of claim 8 wherein each conductive terminal of the female connector includes a distal end extending from the contact portion thereof in a direction away from the receptacle and in alignment with an abutment portion of the terminal to provide an anti-stress means for the contact portion.

* * * * *